US012722201B2

(12) United States Patent
Yuan

(10) Patent No.: US 12,722,201 B2
(45) Date of Patent: Sep. 1, 2026

(54) FAUCET AND MANUFACTURING METHOD THEREOF

(71) Applicant: Quming Yuan, Jiangmen (CN)

(72) Inventor: Quming Yuan, Jiangmen (CN)

( * ) Notice: Subject to any disclaimer, the term of this patent is extended or adjusted under 35 U.S.C. 154(b) by 0 days.

(21) Appl. No.: 19/292,141

(22) Filed: Aug. 6, 2025

(65) Prior Publication Data

US 2025/0353075 A1 Nov. 20, 2025

(30) Foreign Application Priority Data

May 14, 2025 (CN) ..... 202510616202.7

(51) Int. Cl.

| | |
|---|---|
| ***B22D 17/22*** | (2006.01) |
| ***B22D 17/00*** | (2006.01) |
| ***B22D 18/02*** | (2006.01) |
| ***B22D 19/00*** | (2006.01) |
| ***B22D 19/16*** | (2006.01) |
| ***B22D 29/00*** | (2006.01) |
| ***E03C 1/02*** | (2006.01) |
| ***E03C 1/04*** | (2006.01) |

(52) U.S. Cl.

CPC ..... *B22D 17/22* (2013.01); *B22D 17/00* (2013.01); *B22D 18/02* (2013.01); *B22D 19/0072* (2013.01); *B22D 19/16* (2013.01); *B22D 29/005* (2013.01); *E03C 1/02* (2013.01); *E03C 1/04* (2013.01)

(58) Field of Classification Search

CPC .. B22D 17/22; B22D 19/0072; B22D 29/005; B22D 17/00; B22D 18/02; B22D 19/16; E03C 1/02; E03C 1/04

USPC ..... 137/375, 801

See application file for complete search history.

(56) References Cited

U.S. PATENT DOCUMENTS 2,219,471 A * 10/1940 Davis ..... F16K 1/42 164/DIG. 2

2,795,844 A * 6/1957 Liszak ..... B22C 9/24 164/75

(Continued)

FOREIGN PATENT DOCUMENTS

CN 202660011 Y 1/2013

CN 104302422 A 1/2015

(Continued)

OTHER PUBLICATIONS

ISR of PCT/CN2025/107141.

(Continued)

*Primary Examiner* — John Bastianelli

(74) *Attorney, Agent, or Firm* — Hemisphere Law, PLLC

(57) ABSTRACT

A faucet includes a metal liner and a metal valve body. The metal valve body is formed by high-pressure die casting and covers the metal liner. A metallurgical bonding interface is formed between an outer surface of the metal liner and a corresponding inner surface of the metal valve body, and a shear strength of the metallurgical bonding interface is not less than 30 MPa. The metal valve body includes a water inlet valve body and a water outlet valve body that are integrally formed, and the water outlet valve body is in a bent connection with the water inlet valve body. The metal liner includes a water inlet pipe section and a water outlet pipe section that are integrally formed. A wall thickness of the metal liner is 0.5 mm to 2 mm.

15 Claims, 6 Drawing Sheets

(56) References Cited

U.S. PATENT DOCUMENTS

| | | | | |
|---|---|---|---|---|
| 3,414,001 | A * | 12/1968 | Woodford | E03C 1/102 285/8 |
| 5,165,121 | A * | 11/1992 | McTargett | E03C 1/02 4/678 |
| 6,152,180 | A * | 11/2000 | Yang | E03C 1/0404 4/678 |
| 6,817,379 | B2 * | 11/2004 | Perla | E03C 1/0404 4/678 |
| 9,573,191 | B2 * | 2/2017 | Jagtap | B22D 19/00 |
| 10,046,385 | B2 * | 8/2018 | Gossing | B22D 19/0045 |
| 2006/0124183 | A1 * | 6/2006 | Kuo | E03C 1/0404 137/801 |
| 2009/0007977 | A1 * | 1/2009 | Wildfang | E03C 1/08 137/801 |
| 2023/0287986 | A1 | 9/2023 | Hung | |
| 2024/0309620 | A1 | 9/2024 | Ye et al. | |
| 2025/0154750 | A1 | 5/2025 | Tseng | |

FOREIGN PATENT DOCUMENTS

| | | | |
|---|---|---|---|
| CN | 110744046 | A | 2/2020 |
| CN | 115464116 | X | 12/2022 |
| CN | 115464116 | Y | 12/2022 |
| CN | 118875249 | | 11/2024 |
| JP | H11151723 | A | 6/1999 |

OTHER PUBLICATIONS

佟乐乐等(Tong, Lele et al.). 原砂粒度, 树脂加入量对呋喃树脂砂强度的影响 "(Effects of Grain Size and Resin Content on Strength of Furan Resin Sand)". 特种铸造及有色合金 (Special Casting & Nonferrous Alloys), vol. 40, No. 02, Feb. 20, 2020 (Feb. 20, 2020), pp. 139-142, ISSN: 1001-2249, pp. 140-141, sections 1-2.

* cited by examiner

| Example | Compressive strength ($kg/cm^2$) | |
|---|---|---|
| Example 1 | Resin sand (after compression-molding) | 10 $kg/cm^2$ |
| | Stainless-steel liner | 80 $kg/cm^2$ |
| | Stainless-steel liner filled with a resin sand | 280 $kg/cm^2$ |
| Example 2 | Resin sand (after compression-molding) | 10 $kg/cm^2$ |
| | Stainless-steel liner | 35 $kg/cm^2$ |
| | Stainless-steel liner filled with a resin sand | 205 $kg/cm^2$ |
| Example 3 | Resin sand (after compression-molding) | 10 $kg/cm^2$ |
| | Stainless-steel liner | 150 $kg/cm^2$ |
| | Stainless-steel liner filled with a resin sand | 550 $kg/cm^2$ |
| Example 4 | Resin sand + silica gel (after compression-molding) | 13 $kg/cm^2$ |
| | Stainless-steel liner | 80 $kg/cm^2$ |
| | Stainless-steel liner filled with a resin sand and a silica gel | 305 $kg/cm^2$ |

FIG. 5

| Example | Test point | Wall thickness/mm | Roughness of an inner wall of a liner/μm |
|---|---|---|---|
| Example 1 | Test point 1 | 0.5 | 1.0 |
| | Test point 2 | 0.5 | 1.1 |
| | Test point 3 | 0.5 | 1.0 |
| | Test point 4 | 0.49 | 1.0 |
| Example 2 | Test point 1 | 0.32 | 1.5 |
| | Test point 2 | 0.30 | 1.4 |
| | Test point 3 | 0.28 | 1.5 |
| | Test point 4 | 0.29 | 1.6 |
| Example 3 | Test point 1 | 1.0 | 1.0 |
| | Test point 2 | 1.0 | 1.0 |
| | Test point 3 | 1.0 | 1.0 |
| | Test point 4 | 1.0 | 1.0 |
| Example 4 | Test point 1 | 0.5 | 0.9 |
| | Test point 2 | 0.5 | 0.8 |
| | Test point 3 | 0.5 | 0.8 |
| | Test point 4 | 0.5 | 0.9 |

FIG. 6

FAUCET AND MANUFACTURING METHOD THEREOF

TECHNICAL FIELD

The present disclosure relates to the technical field of faucets, and particularly relates to a faucet and a manufacturing method thereof.

BACKGROUND

Metal faucets currently hold a significant market share. Metal faucets are primarily manufactured through the traditional low-pressure die casting technology, which is specifically as follows: A sand core is molded, a cast metal alloy is then injected into a mold cavity under a relatively low pressure to form a faucet, and the sand core is then flushed out to create a space for water passage in the faucet. The traditional sand cores are primarily made of resin materials with a compressive capacity of 60 kg/cm$^2$ to 80 kg/cm$^2$, and are not suitable for high-pressure die casting. This manufacturing process has the following major drawbacks: The manufacturing process has low efficiency. Products from the manufacturing process have irregular appearance, poor consistency, rough surfaces prone to sand holes, and rough inner walls. Additionally, sand core residues cannot be completely removed and will remain on an inner wall, and these sand core residues may fall off during electroplating to pollute an electroplating tank. Moreover, because zinc alloy and aluminum alloy faucets can hardly come into direct contact with running water, plastic pipes typically need to be arranged along the inner walls of these faucets to allow water passage. Due to the limited plasticity of plastic pipes, the appearance of such a faucet is severely constrained, and a complex structure is required for a valve core, resulting in high costs.

The applicants disclose a faucet, a manufacturing method of the faucet, and a mold for producing the faucet in CN115464116A. In this patent, the filler core in the prior art is replaced with a hollow liner. A filler oil is injected into the liner to support the liner. As a result, the need for core extraction after forming is eliminated, and the filler oil can be simply drained to produce a faucet with a smooth internal channel. This method exhibits high production efficiency, reduces the material consumption, and can lead to a faucet with a uniform wall thickness. However, this method shows high technical requirements and cannot achieve the industrial production. Therefore, the applicants have made improvements on this basis to reduce the technical difficulty in the production for faucets.

SUMMARY

The technical problem to be solved by the present disclosure is to provide a manufacturing method for a faucet that is simple and has low difficulty. Faucets manufactured by the improved manufacturing method include a stainless-steel liner that can come into direct contact with water and is smooth, and have regular appearance and high consistency.

To solve the above technical problem, a first aspect of the present disclosure provides a manufacturing method of a faucet, including:

(1) fabricating a liner with a cavity;

(2) injecting a liner filler into the cavity of the liner, and allowing forming of the liner filler in the cavity; and (3) placing the liner injected with the liner filler in a mold, conducting high-pressure die casting, cooling for solidification, and removing the liner filler from the cavity to produce the faucet, where the liner filler is one or more selected from the group consisting of a resin, a silica gel, a foam material, a resin sand, a steel ball, a cement, a wood shaving, a flour, a wax, an ice, and a dry ice; and a raw material for fabricating the liner is at least one selected from the group consisting of a stainless steel, a titanium metal, copper, and aluminum.

As an improvement to the above solution, the liner injected with the liner filler has a compressive strength of 200 kg/cm$^2$ to 600 kg/cm$^2$.

As an improvement to the above solution, the liner is manufactured through stamping, drawing, bulging, welding, and computer numerical control machining, and has a thickness of 0.1 mm to 1 mm.

As an improvement to the above solution, when a wall thickness of the stainless steel is 0.5 mm, a compressive strength is 70 kg/cm$^2$ to 90 kg/cm$^2$.

The stainless steel includes the following chemical components in mass percentages: C: ≤0.08%, Cr: 16.00% to 20.00%, Ni: 8.00% to 15.00%, Si: ≤1.00%, Mn: ≤2.00%, and P: ≤0.045%.

As an improvement to the above solution, the liner filler is compression-molded under a pressure after entering the liner, and the pressure is 0.2 MPa to 0.6 MPa; and the liner filler has a particle size of 150 μm to 900 μm.

As an improvement to the above solution, the liner filler is a resin sand, and the resin sand has a strength of 8 kg/cm$^2$ to 80 kg/cm$^2$ after being compression-molded; and a volume proportion of the liner filler after being compression-molded in the cavity is 95% to 98%.

As an improvement to the above solution, a content of the resin in the resin sand is 0.4 wt % to 0.9 wt %; a fluidity of the resin sand is 25° to 30°;

in the resin sand, a proportion of particles of 250 μm to 350 μm is 5% to 7%, a proportion of particles of 400 μm to 450 μm is 69% to 73%, and a proportion of particles of 550 μm to 650 μm is 20% to 24%; and a melting point of the resin sand is 105° C. to 115° C.

As an improvement to the above solution, the liner filler in the cavity is removed through a high-frequency vibration or machining.

As an improvement to the above solution, after the liner injected with the liner filler is placed in the mold, a molten or semi-molten metal is injected for the high-pressure die casting to form an outer layer; and the high-pressure die casting is conducted with an injection pressure of 20 MPa to 100 MPa, an injection time of 0.01 s to 0.5 s, and a forming time of 0.01 s to 0.5 s.

As an improvement to the above solution, after the liner injected with the liner filler is placed in the mold, a molten or semi-molten alloy is injected for the high-pressure die casting to form an outer alloy layer; and the alloy is a zinc alloy and/or an aluminum alloy.

A second aspect of the present disclosure also provides a faucet manufactured by the manufacturing method described above, including a metal liner and a metal valve body that is produced through high-pressure die casting and covers the metal liner, where an outer surface of the metal liner and a corresponding inner surface of the metal valve body constitute a metallurgical bonding interface, and a shear strength of the metallurgical bonding interface is not less than 30 Mpa; the metal valve body includes a water inlet valve body and a water outlet valve body that are integrally formed; an end of the water inlet valve body that is away from the water outlet valve body is configured for support positioning and water intake; the water outlet valve body is in a bent connection with the water inlet valve body; the metal liner includes a water inlet pipe section and a water outlet pipe section that are integrally formed; and the water inlet pipe section is arranged corresponding to a junction between the water inlet valve body and the water outlet valve body, and the water outlet pipe section is arranged corresponding to the water outlet valve body.

As an improvement to the above solution, the faucet further includes a valve nozzle, where the valve nozzle is removably connected to an end of the water outlet valve body that is away from the water inlet valve body through a sealing ring.

As an improvement to the above solution, the faucet further includes a valve core and a valve handle, where the valve core is arranged at the water inlet pipe section and is hermetically connected to the metal liner; and the valve handle includes a control head that penetrates through the water inlet valve body and is connected to the valve core, and a free handle body connected to the control head.

As an improvement to the above solution, a surface of the metal valve body is treated through electroplating or wire drawing.

As an improvement to the above solution, a wall thickness of the liner is 0.5 mm to 2 mm.

As an improvement to the above solution, a material of the liner includes at least one selected from the group consisting of a stainless steel, a titanium metal, copper, and aluminum.

As an improvement to the above solution, the faucet includes a liner and an outer alloy layer covering an outer side of the liner; and the outer alloy layer is produced as follows: injecting a liner filler into a cavity, allowing forming of the liner filler, injecting a molten or semi-molten alloy, and conducting high-pressure die casting, such that the alloy wraps the outer side of the liner.

The implementation of the present disclosure has the following beneficial effects:

In the present disclosure, a liner with a cavity is first fabricated, then a liner filler is injected into the cavity of the liner and formed within the cavity, then the liner injected with the liner filler is placed in a mold, casting is conducted, cooling is conducted for solidification, and the liner filler in the cavity is removed to produce a faucet. This manufacturing method avoids the need for vacuuming, reduces the difficulty of industrial production, and is simple and efficient. Moreover, the injection of the liner filler into the liner can effectively enhance the compressive strength of the liner, such that the faucet can be manufactured through high-pressure die casting. Further, the arrangement of the liner allows the direct contact of the faucet with water, avoids the arrangement of the conventional plastic pipe, simplifies the valve core structure of the faucet, and reduces the production cost.

BRIEF DESCRIPTION OF THE DRAWINGS

FIG. 5 is a comparative analysis chart of test results for compressive strengths in Examples 1 to 4; and FIG. 6 is a comparative analysis chart of test results for wall thicknesses and roughnesses of inner walls of liners in Examples 1 to 4.

DETAILED DESCRIPTION OF THE EMBODIMENTS

Figure 1:
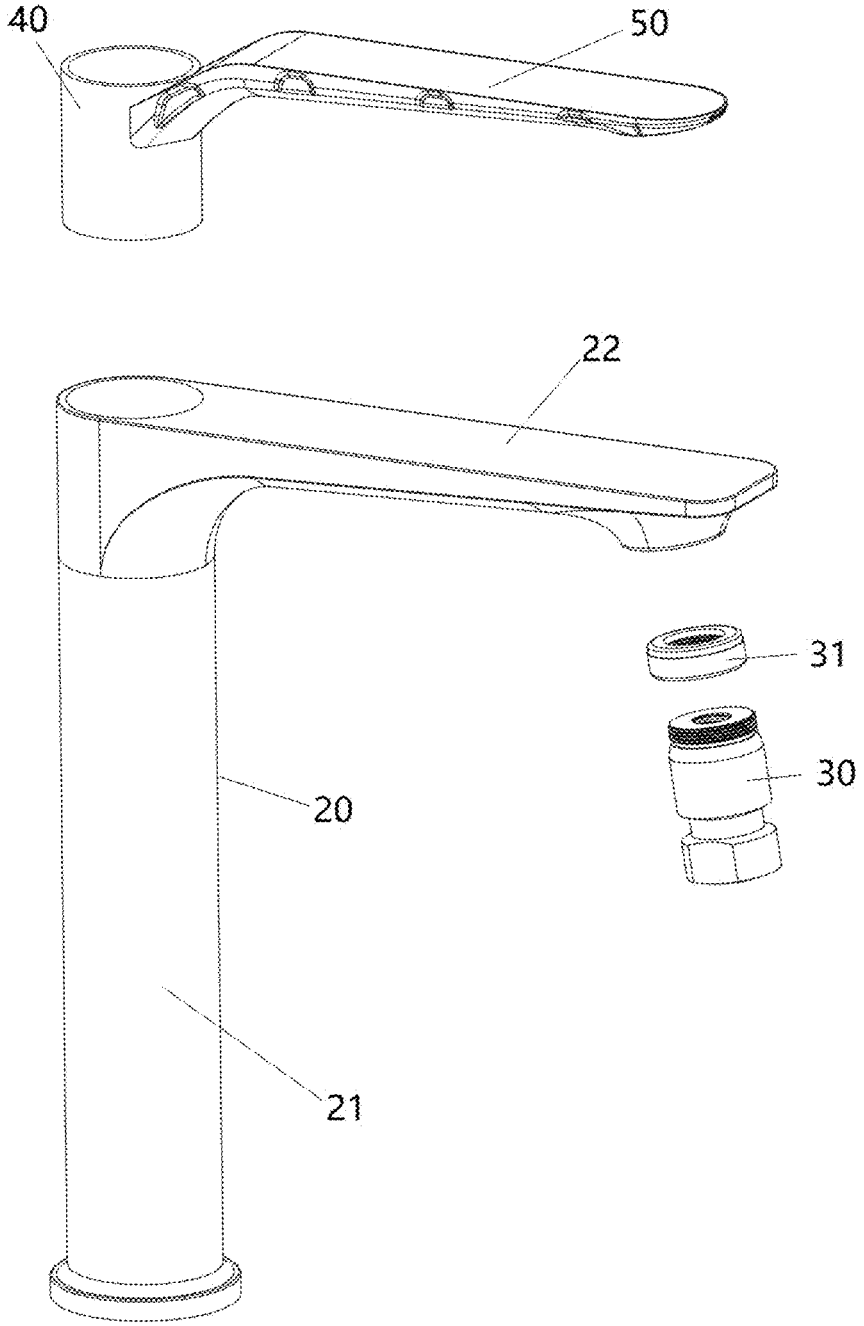
FIG. 1 is an exploded view of a structure of the faucet provided by the present disclosure.

To make the objectives, technical solutions, and advantages of the present disclosure clear, the present disclosure will be further described in detail below with reference to specific embodiments.

To solve the above problem, a first aspect of the present disclosure provides a manufacturing method of a faucet, including:

(1) A liner with a cavity is fabricated.

(2) A liner filler is injected into the cavity of the liner, and is formed in the cavity.

(3) The liner injected with the liner filler is placed in a mold, high-pressure die casting is conducted, cooling is conducted for solidification, and the liner filler is removed from the cavity to produce the faucet.

A resin sand core adopted for the manufacturing of the traditional faucet is easily disrupted by a high pressure, such that both the inner wall and the appearance will undergo irregular deformation, resulting in poor product consistency. In the present disclosure, the vacuuming operation is avoided, and the liner filler can be directly introduced into the liner, which reduces the difficulty of the manufacturing method and improves the production efficiency. The fabrication of the liner with the cavity and the injection of the liner filler into the liner can enhance the compressive capacity of the liner, such that the liner is suitable for high-pressure die casting. Additionally, the liner can come into direct contact with water, which eliminates the arrangement of a plastic pipe on an inner wall of the faucet and facilitates the simplification of a structure of a valve core of the faucet, thereby reducing the production cost.

Preferably, the liner injected with the liner filler has a compressive strength of 200 $kg/cm^2$ to 600 $kg/cm^2$.

Preferably, in the step (1), a raw material for fabricating the liner includes at least one selected from the group consisting of a stainless steel, a titanium metal, copper, and aluminum.

Further, when a wall thickness of the stainless steel is 0.5 mm, a compressive strength is 70 $kg/cm^2$ to 90 $kg/cm^2$. It should be noted that the compressive strength of the stainless steel here is tested with a standard stainless steel block having dimensions of 11.8 mm (height)*22 mm (width)*70 mm (length)*0.5 mm (wall thickness) as a sample. The stainless steel includes the following chemical components in mass percentages: C: ≤0.08%, Cr: 16.00% to 20.00%, Ni: 8.00% to 15.00%, Si: ≤1.00%, Mn: ≤2.00%, and P: ≤0.045%. This chemical composition enables the liner to directly contact water while guaranteeing the strength of the liner, and prevents the precipitation of metal elements during long-term use to affect the service. The contents of C, Si, Mn, and Ni significantly affect the strength and corrosion resistance of the liner, thereby impacting the safety and service life of the liner. More preferably, the stainless steel complies with the requirements regarding stainless steel materials for drinking water specified in European and/or American standards. The stainless steel includes, but is not limited to, models such as 304, 304L, 306, 316, and 316L.

Preferably, the liner is manufactured through stamping, drawing, bulging, welding, and computer numerical control machining, and has a thickness of 0.1 mm to 1 mm. If the thickness of the liner is too small, the strength of the liner will be reduced, and the liner will be deformed during a casting process, resulting in a non-uniform wall thickness of the faucet. If the thickness of the liner is too large, the difficulty in removing the liner filler from the liner and the difficulty in fabricating the liner will increase, making the production efficiency reduced. More preferably, the thickness of the liner is 0.3 mm to 1 mm.

In the present disclosure, if the liner is improved merely in terms of a raw material and a thickness, the strength of the liner itself still cannot withstand a high pressure, which means that the faucet cannot be manufactured through high-pressure die casting. Therefore, the liner filler is filled into the liner and compression-molded under a pressure, such that the liner filler is filled and formed in the cavity and bonded with the liner. This design can effectively improve the compressive strength of the liner, and significantly enhance the compressive capacity.

Preferably, in the step (2), the liner filler is a powder with a particle size of 150 μm to 900 μm. The liner filler is compression-molded under a pressure after entering the liner. A pressure for the compression-molding can be 0.2 MPa to 0.6 MPa, as long as there are no loose structures on the surface of the resin sand after being compression-molded. If the particle size of the liner filler is too large, there will be too-large voids among liner filler particles, and the molding will fail or an excessive pressure will be required for compression-molding. If the pressure is too large, the liner may be deformed. If the particle size of the liner filler is too small, there will be problems such as poor powder fluidity, an uneven thickness after compression-molding, and incomplete filling of the cavity. Moreover, the pressure for compression-molding can be controlled to ensure the smoothness and uniform thickness for an inner wall of the liner.

Further, the liner filler is one or more selected from the group consisting of a resin, a silica gel, a foam material, a resin sand, a steel ball, a cement, a wood shaving, a flour, a wax, an ice, and a dry ice. The liner filler can also be another conventional powder, including, but not limited to, a gypsum powder, a rice flour, a starch, an iron powder, a copper powder, an aluminum powder, and any combination thereof. Specifically, one or more selected from the group consisting of a resin sand, a resin, a silica gel, a foam material, a steel ball, a cement, a wood shaving, a flour, and a wax can be thoroughly mixed, and then compression-molded under a pressure to produce a mixture as the liner filler. The filling of the liner filler can be reasonably adjusted to improve a compressive strength of the liner during high-pressure die casting, thereby satisfying the casting conditions in a wide pressure range. Additionally, the fluidity, temperature stability, etc. of the liner filler can be adjusted. When the ice or dry ice is adopted as the liner filler, a time of the high-pressure die casting is short, which can ensure that the ice or dry ice will not be thawed, thereby providing a sufficient compressive strength. In special cases, a heat-insulating material can also be arranged.

In some preferred and specific embodiments, the liner filler is a resin sand that has a strength of 8 kg/cm$^2$ to 80 kg/cm$^2$ after being compression-molded, and a volume proportion of the liner filler after being compression-molded in the cavity is 95% to 98%. Compared with the liner or the compression-molded resin sand alone, the combination of the liner filler with the specified compressive strength and the liner with the specific thickness can increase the compressive strength of the liner by 3 times or more, such that the liner can withstand a high pressure. Moreover, the liner can be completely removed through a high-frequency vibration subsequently, which is simple.

Further, a content of the resin in the resin sand is 0.4 wt % to 0.9 wt %, and a fluidity of the resin sand is 25° to 30°, which can guarantee both the strength and the viscosity of the resin sand as a liner filler. In the resin sand, a proportion of particles of 250 μm to 350 μm is 5% to 7%, a proportion of particles of 400 μm to 450 μm is 69% to 73%, and a proportion of particles of 550 μm to 650 μm is 20% to 24%. Preferably, in the resin sand, a proportion of particles of 300 μm is 5% to 7%, a proportion of particles of 425 μm is 69% to 73%, and a proportion of particles of 600 μm is 20% to 24%. A melting point of the resin sand is 105° C. to 115° C., and a curing time of the resin sand is about 70 s, which is beneficial for the generation of a compact liner filler during compression-molding. Accordingly, the compressive strength of the resin sand as a liner filler can further reach 10 kg/cm$^2$ or above, and the compressive strength of the liner can be significantly improved to 200 kg/cm$^2$ to 600 kg/cm$^2$, such that the liner is suitable for casting under high-pressure conditions. The content of the resin in the resin sand or the particle refinement for the resin sand is conducive to increasing the compressive strength after the resin sand is filled in the stainless-steel liner, but the sand removal is difficult. If the conventional resin sand material is filled as the liner filler in the stainless-steel liner, the compressive strength of the stainless-steel liner cannot be significantly enhanced. In this case, the fabrication of a faucet cannot be achieved through high-pressure die casting, and a faucet fabricated accordingly has a rough inner wall and poor consistency.

In some other preferred and specific embodiments, the liner filler is a mixture of a resin sand and a silica gel in a weight ratio of (1-2):1. The silica gel has a particle size of 150 μm to 500 μm and a Shore hardness of 50 to 90. The resin sand and the silica gel are thoroughly mixed in a specific ratio to produce the liner filler. The resin sand and the silica gel can play a synergistic role to improve the fluidity of the liner filler. Under the action of a pressure, a dense and stable filling body can be formed and bonded with the stainless-steel liner, which can effectively enhance the compressive strength of the stainless-steel liner, enables a smooth inner wall of the stainless-steel liner produced after high-pressure die casting, and achieves high product consistency. Preferably, the silica gel has a particle size of 150 μm to 250 μm and a Shore hardness of 70 to 90. In this case, the silica gel exhibits excellent bonding performance with the resin sand in the present disclosure, and a liner filler produced accordingly has appropriate fluidity, can further improve the compressive strength of the stainless-steel liner, and can be easily removed.

Preferably, the liner filler in the cavity is removed through a high-frequency vibration. This removal method is simple and efficient, which further improves the production efficiency. The complete removal of the liner filler from the cavity can effectively prevent the contamination to an electroplating solution in an electroplating tank subsequently, and can also prevent the influence on a structure of the faucet, thereby avoiding issues such as deformation and damage at a bend of the faucet. Of course, the liner filler in the cavity can also be removed through machining. For example, the liner filler in the cavity can be removed by a manual cutting tool, mechanical milling, drilling, grinding, etc., which are not specifically limited in the present disclosure.

Preferably, in the step (3), the high-pressure die casting is conducted specifically as follows: after the liner injected with the liner filler is placed in the mold, a molten or semi-molten metal is injected for the high-pressure die casting to form an outer layer. After the liner injected with the liner filler is placed in the mold, a forming space is retained between the liner and a core of the mold, the molten or semi-molten metal is injected into the forming space for the high-pressure die casting, and cooling is conducted to form the outer layer covering an outer side of the liner. Optionally, the high-pressure die casting is conducted with an injection pressure of 20 MPa to 100 MPa, an injection time of 0.01 s to 0.5 s, and a forming time of 0.01 s to 0.5 s. Preferably, the injection pressure is 20 MPa to 55 MPa.

Further, after the liner injected with the liner filler is placed in the mold, a molten or semi-molten alloy is injected for the high-pressure die casting to form an outer alloy layer. A material of the outer alloy layer can be a zinc alloy and/or an aluminum alloy, which can provide a high compressive capacity and mechanical strength for the faucet. The zinc alloy has a low cost and excellent casting performance, and can be casted into a complex shape and a thin-walled structure, which meets the diverse design needs. The aluminum alloy has prominent corrosion resistance, is eco-friendly and safe, and can significantly reduce the overall weight of a faucet, which is suitable for the modern light-weight design requirements.

A second aspect of the present disclosure also provides a faucet manufactured by the manufacturing method described above.

Figure 2:
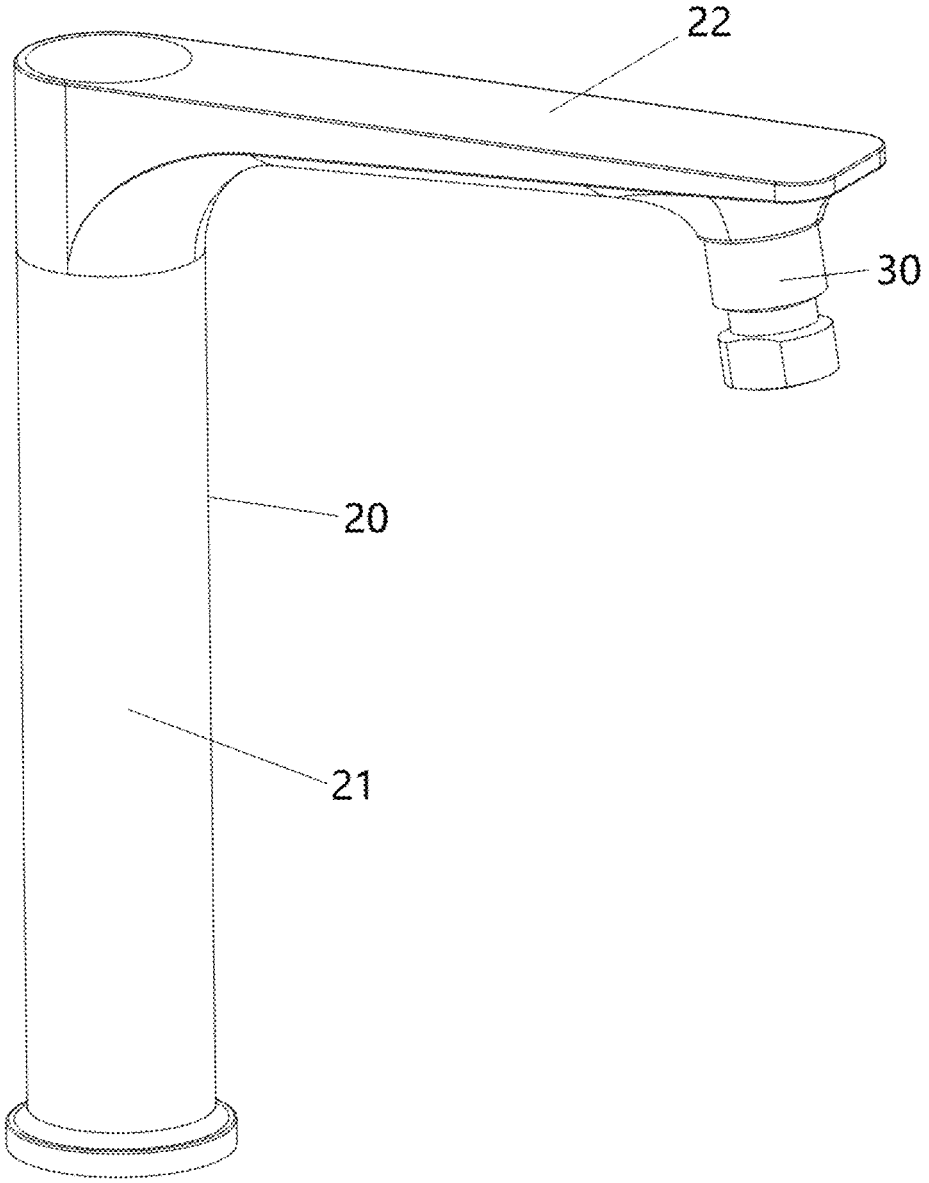
FIG. 2 is a schematic diagram of a structure of an assembly of some components of the faucet in FIG. 1.
Figure 3:
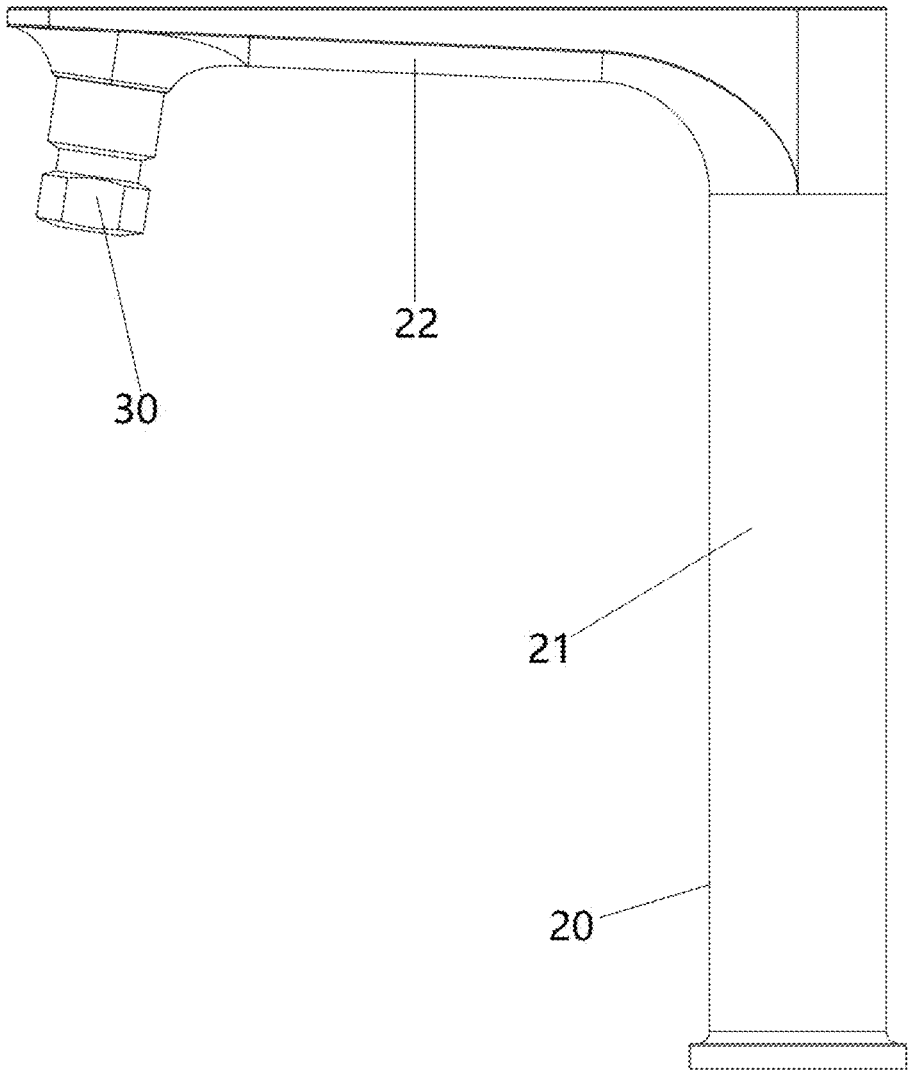
FIG. 3 is a side view of the assembly of some components of the faucet in FIG. 2.
Figure 4:
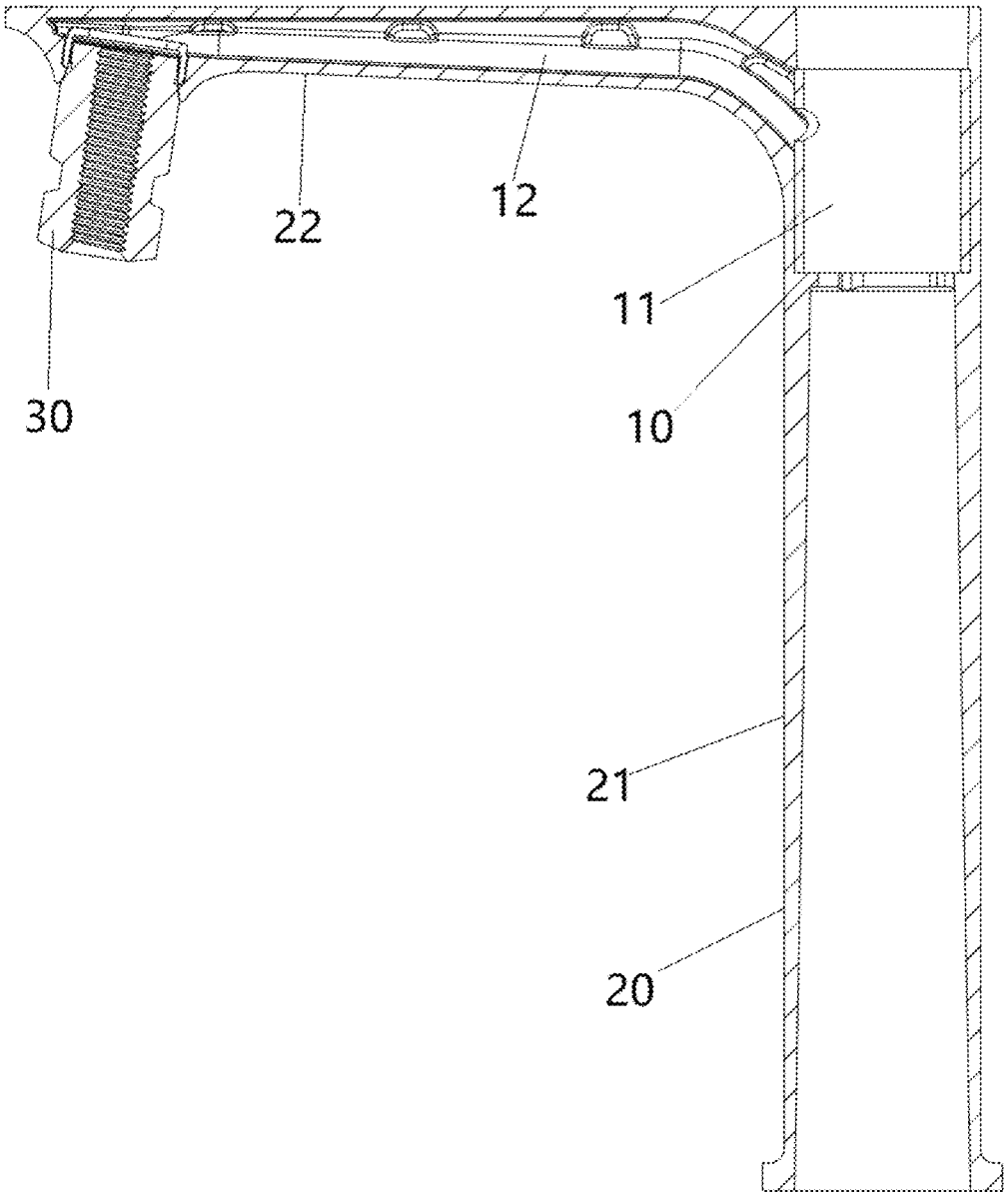
FIG. 4 is a cross-sectional view of the faucet in FIG. 3.

As shown in FIG. 1 to FIG. 4, further, the faucet includes a metal liner 10 and a metal valve body 20 that is produced through high-pressure die casting and covers the metal liner 10.

Further, an outer surface of the metal liner 10 and a corresponding inner surface of the metal valve body 20 constitute a metallurgical bonding interface. The formation of the metallurgical bonding interface by the metal liner 10 and the metal valve body 20 allows seamless tight bonding and thus provides high stability.

Further, a shear strength of the metallurgical bonding interface is not less than 30 Mpa. The metallurgical bonding interface provides a large shear strength, such that the metal liner 10 can be tightly bonded to the metal valve body 20.

Further, the metal valve body 20 includes a water inlet valve body 21 and a water outlet valve body 22 that are integrally formed. An end of the water inlet valve body 21 that is away from the water outlet valve body 22 is configured for support positioning and water intake. The water outlet valve body 22 is in a bent connection with the water inlet valve body 21. The metal liner 10 includes a water inlet pipe section 11 and a water outlet pipe section 12 that are integrally formed. The water inlet pipe section 11 is arranged corresponding to a junction between the water inlet valve body 21 and the water outlet valve body 22, and the water outlet pipe section 12 is arranged corresponding to the water outlet valve body 22.

Further, the faucet further includes a valve nozzle 30. The valve nozzle 30 is removably connected to an end of the water outlet valve body 22 that is away from the water inlet valve body 21 through a sealing ring 31.

Further, the faucet further includes a valve core 40 and a valve handle 50 connected to the valve core 40. The valve core 40 is arranged in the water inlet pipe section 11 and is hermetically connected to the water inlet pipe section 11. The valve handle 50 is located outside the water inlet valve body 21. The valve handle 50 can drive the valve core 40 to move Further, a surface of the metal valve body 20 is treated through electroplating or wire drawing. After the surface is subjected to the electroplating or wire drawing treatment, the faucet is provided with a durable surface.

Further, a wall thickness of the liner 10 is 0.5 mm to 2 mm.

Further, a material of the liner 10 includes at least one selected from the group consisting of a stainless steel, a titanium metal, copper, and aluminum.

Further, the faucet includes a liner and an outer alloy layer covering an outer side of the liner. The faucet has a double-layer structure. The liner has a cavity for water passage, and can ensure the health and safety of water. The outer alloy layer can provide a mechanical strength and a compressive capacity to support the overall stability of the structure. The liner and the outer alloy layer together constitute a double-layer protection system for the faucet. The wall thickness of the liner is 0.1 mm to 1 mm. A thickness of the outer alloy layer can be reasonably adjusted according to actual needs.

Further, the outer alloy layer is produced as follows: a liner filler is injected into the cavity and formed, a molten or semi-molten alloy is injected, and high-pressure die casting is conducted, such that the alloy wraps the outer side of the liner. The integral molding process for the faucet in the present application avoids the assembly of the traditional plastic pipe, resulting in high efficiency. The liner can directly contact water, which improves the water quality. The liner provides sufficient support for the formation of the outer alloy layer, which facilitates the fabrication of faucets with a uniform wall thickness and high consistency.

The present disclosure is further described below with reference to specific examples.

Example 1

In this example, a faucet was provided. The faucet was manufactured by the following method:

(1) A liner with a cavity was fabricated through stamping, drawing, bulging, computer numerical control machining, and welding.

A raw material for fabricating the liner was a stainless steel including the following chemical components in mass percentages: C: ≤0.08%, Cr: 18.00% to 20.00%, Ni: 8.00% to 10.00%, Si: ≤1.00%, Mn: ≤2.00%, and P: ≤0.045%. The liner had a thickness of 0.5 mm and dimensions of 11.18 mm*22.16 mm*70 mm.

(2) A resin sand was injected into the cavity of the liner, and was formed in the cavity.

Relevant parameters for the resin sand were as follows: A resin content was 0.6 wt %. A melting point was 110° C., a curing time was 70 s, and a fluidity (angle of repose) was 27.17°. In the resin sand, a proportion of particles of 300 μm was 5% to 7%, a proportion of particles of 425 μm was 69% to 73%, and a proportion of particles of 600 μm was 20% to 24%.

The resin sand was compression-molded under a pressure of 0.4 MPa after entering the liner. A volume proportion of the resin sand after being compression-molded in the cavity was 97%.

(3) The liner injected with the resin sand was placed in a mold, and high-pressure die casting was conducted with an injection pressure of 25 MPa, an injection time of 0.1 s, and a forming time of 0.3 s. Cooling was conducted for solidification. The resin sand was removed from the cavity through a high-frequency vibration to produce the faucet.

Example 2

In this example, a faucet was provided. This example was basically the same as Example 1, except that:

The thickness of the liner was 0.3 mm.

Example 3

In this example, a faucet was provided. This example was basically the same as Example 1, except that:

The thickness of the liner was 1 mm.

The high-pressure die casting was conducted with an injection pressure of 50 MPa.

Example 4

In this example, a faucet was provided. This example was basically the same as Example 1, except that:

A resin sand and a silica gel were injected into the cavity of the liner and formed in the cavity. A mass ratio of the resin sand to the silica gel was 2:1. The silica gel had a particle size of 150 μm to 250 μm and a Shore A hardness of 70 to 90.

Performance Testing

1. Through a compression test in accordance with GB/T 7314-2017, compressive strengths of resin sand liner fillers after compression-molding, stainless-steel liners, and liner filler-filled liners in the examples were evaluated. These three test samples all had dimensions of 11.18 mm×22.16 mm×70 mm, and a wall thickness of a liner was 0.5 mm. Test results for compressive strengths of Examples 1 to 4 were shown in FIG. 5.

The test results show that the filling of the resin sand in the stainless-steel liner and the optimization of the thickness of the liner can effectively improve the compressive capacity to make the liner well suited for high-pressure die casting. When the wall thickness of the stainless-steel liner is 0.5 mm to 1.0 mm, there is a prominent effect. The use of a mixture of the resin sand with another powder such as a silica gel as the liner filler can further enhance the compressive strength of the stainless-steel liner.

2. A wall thickness of a faucet and a roughness of an inner wall of a liner in each example were tested by the following method: A faucet produced in an example was divided into four equal parts along a length, and a test point was set for each part, resulting in four test points. A wall thickness and a roughness of an inner wall of a cavity were tested at these four points. An average wall thickness and an average roughness of these four test points were calculated and recorded. Test results for wall thicknesses and roughnesses of inner walls of liners in Examples 1 to 4 were shown in FIG. 6.

According to the test results, in the present disclosure, a liner is arranged, and a specific resin sand is filled in the liner, which eliminates the vacuuming operation and simplifies the manufacturing method. Moreover, when a wall thickness of a liner of a faucet produced by the present disclosure is 0.5 mm to 1.0 mm, the faucet has a smooth inner wall, a uniform thickness, and high consistency.

The above are only preferred examples of the present disclosure, and are not intended to limit the claimed scope of the present disclosure. Therefore, equivalent changes made according to the claims of the present disclosure are still within the scope of the present disclosure.

What is claimed is:

1. A faucet, comprising:

a metal liner that is prefabricated and has a cavity; and a metal valve body, that is produced through high-pressure die casting and covers the metal liner, wherein the metal liner is made of a different material than that of the metal valve body; wherein the metal liner is placed in a die casting mold and is completely overmolded by the metal valve body through the high-pressure die casting;

wherein, prior to the high-pressure die casting, a liner filler is injected into the cavity of the metal liner and formed therein to support the metal liner, and after the high-pressure die casting, the liner filler is removed from the cavity, such that the metal liner has a smooth inner surface, and wherein the metal liner is configured such that water flowing through the faucet contacts only the metal liner without contacting the metal valve body;

wherein an outer surface of the metal liner and a corresponding inner surface of the metal valve body constitute a metallurgical bonding interface, and a shear strength of the metallurgical bonding interface is not less than 30 Mpa;

wherein the metal valve body comprises a water inlet valve body and a water outlet valve body that are integrally formed; wherein an end of the water inlet valve body facing away from the water outlet valve body is configured for support positioning and water intake; the water outlet valve body is in a bent connection with the water inlet valve body; the metal liner comprises a water inlet pipe section and a water outlet pipe section that are integrally formed; and the water inlet pipe section is arranged corresponding to a junction between the water inlet valve body and the water outlet valve body, and the water outlet pipe section is arranged corresponding to the water outlet valve body.

2. The faucet according to claim 1, further comprising a valve nozzle, wherein the valve nozzle is removably connected to an end of the water outlet valve body facing away from the water inlet valve body through a sealing ring.

3. The faucet according to claim 1, further comprising a valve core and a valve handle, wherein the valve core is arranged at the water inlet pipe section and is hermetically connected to the metal liner; and the valve handle comprises a control portion that penetrates through the water inlet valve body and is connected to the valve core, and further comprises a handle body that is located outside the water inlet valve body and that is connected to the control portion.

4. The faucet according to claim 1, wherein a surface of the metal valve body is treated through electroplating.

5. The faucet according to claim 1, wherein a wall thickness of the liner is 0.5 mm to 2 mm.

6. The faucet according to claim 1, wherein a material of the liner comprises at least one selected from the group consisting of a stainless steel, a titanium metal, copper, and aluminum.

7. The faucet according to claim 2, wherein the sealing ring is disposed in a slot defined in the end of the water outlet valve body and is disposed between the valve nozzle and the water outlet valve body to provide a fluid-tight seal.

8. The faucet according to claim 6, wherein the material of the liner is stainless steel, which comprises, in mass percentages: C≤0.08%, Cr 16.00% to 20.00%, Ni 8.00% to 15.00%, Si≤1.00%, Mn≤2.00%, and P≤0.045%.

9. The faucet according to claim 1, wherein the liner filler comprises at least one selected from the group consisting of resin, silica gel, foam material, resin sand, steel ball, cement, wood shaving, flour, wax, ice, and dry ice.

10. The faucet according to claim 1, wherein the liner filler is compression-molded within the cavity of the metal liner.

11. The faucet according to claim 1, wherein the liner filler is removed by high-frequency vibration or machining.

12. The faucet according to claim 1, wherein the metal valve body is produced through high-pressure die casting with an injection pressure suitable for forming a metallurgical bonding interface.

13. The faucet according to claim 1, wherein the metal valve body is made of a zinc alloy or an aluminum alloy.

14. The faucet according to claim 1, wherein the metal liner is made of a material selected from the group consisting of stainless steel, titanium, copper, and wherein the metal valve body is made of a zinc alloy or an aluminum alloy.

15. The faucet according to claim 1, wherein a surface of the metal valve body is treated through wire drawing.

* * * * *